US007866677B1

(12) United States Patent
Rothstein et al.

(10) Patent No.: US 7,866,677 B1
(45) Date of Patent: Jan. 11, 2011

(54) ROLLATOR HAVING A USER-ADJUSTABLE TRACK WIDTH

(76) Inventors: Polly Rothstein, 140 Lincoln Ave., Purchase, NY (US) 10577; Philip J. Margolis, 8 Bruce Rd., Mamaroneck, NY (US) 10543; Aaron Leith Margolis, 8 Bruce Rd., Mamaroneck, NY (US) 10543; Noah Adam Margolis, 8 Bruce Rd., Mamaroneck, NY (US) 10543

( * ) Notice: Subject to any disclaimer, the term of this patent is extended or adjusted under 35 U.S.C. 154(b) by 0 days.

(21) Appl. No.: 12/606,371

(22) Filed: Oct. 27, 2009

(51) Int. Cl.
*B62B 3/02* (2006.01)
*B62B 1/12* (2006.01)
*A61H 3/04* (2006.01)

(52) U.S. Cl. ..... 280/47.34; 280/639; 280/646; 135/67

(58) Field of Classification Search ..... 280/47.34, 280/47.41, 47.35, 47.22, 47.17, 47.19, 639, 280/645, 646; 135/67, 74, 85; 482/142, 482/66, 67, 68
See application file for complete search history.

(56) References Cited

U.S. PATENT DOCUMENTS

| | | | | |
|---|---|---|---|---|
| 3,165,314 | A | 1/1965 | Clearman et al. | |
| 3,273,888 | A | 9/1966 | Burns | |
| 4,180,086 | A * | 12/1979 | Thomas | 135/67 |
| 5,020,560 | A | 6/1991 | Turbeville | |
| 6,070,603 | A * | 6/2000 | Politz | 135/67 |
| 6,533,310 | B2 | 3/2003 | O'Shea et al. | |
| 6,550,802 | B2 | 4/2003 | Sheehan | |
| 6,688,633 | B2 | 2/2004 | van't Schip | |
| 7,017,938 | B2 | 3/2006 | Kinzel | |
| 7,111,856 | B1 * | 9/2006 | Graham | 280/87.021 |
| D561,065 | S * | 2/2008 | Kindberg et al. | D12/130 |
| D567,720 | S | 4/2008 | Graham | |
| 2004/0135326 | A1 | 7/2004 | Palmers et al. | |
| 2006/0255564 | A1 | 11/2006 | Ayre | |
| 2008/0042474 | A1 | 2/2008 | Dickie et al. | |
| 2009/0014985 | A1 | 1/2009 | Huang | |

OTHER PUBLICATIONS http://www.alltimemedical.com/category.html?view_all=yes &tp_c_category_id=107&oby=%20p.price%20&obydir=asc.
http://www.WendysWalkers.com/Folding_Walker_s/49.htm.
http://www.WendysWalkers.com/Rollator_s/53.htm.
http://www.activelivingnow.com/Rolling_Walkers_Rollators_s/30.htm?searching=Y&sort=2&cat=30&show=10&page=1.
http://www.alldaymedical.com/walking-aids/wheeled-walkers/.
http://www.alldaymedical.com/walking-aids/walkers/.
http://www.specialtymedicalsupply.com/walkers-rollators-canes/.
http://www.bindependent.com/hompg/bi/bindep/store/aisles/s-needs/mobility/winniewalker.htm.

(Continued)

*Primary Examiner*—J. Allen Shriver, II
*Assistant Examiner*—John R Olszewski
(74) *Attorney, Agent, or Firm*—Amster Rothstein & Ebenstein, LLP

(57) ABSTRACT

A rollator having a variable track width that can be adjusted across a range of widths for use in operation by pivoting a pair of support members, wherein the alignment of the wheels is maintained in the direction of travel during operation across the range of track widths.

7 Claims, 10 Drawing Sheets

OTHER PUBLICATIONS http://www.bindependent.com/hompg/bi/bindep/store/aisles/s-needs/mobility/dolomite.htm.
http://www.bindependent.com/cgi-bin/shopper.cgi?preadd=action&key=snm153.
http://www.bindependent.com/hompg/bi/bindep/store/aisles/easierliv/trionic.htm.
http://www.homehealthmedicalequipment.com/walkers.html.
http://www.volaris.se/?gclid=CNDDn-Dr3KICFSQ65QodPVI7yA.
http://www.elderluxe.com/store/index.asp?DEPARTMENT_ID=69&pg=2&max=1000&gclid=CO790szu3KICFciA5QodOIL9xg.
http://www.amazon.com/s/ref=nb_sb_noss?url=search-alias%3Daps&field-keywords=walkers+rollators&x=16&y=22.
http://www.activelivingnow.com/4_Wheel_Rolling_Walkers_s/103.htm.
http://www.alimed.com/Alimed/product/Winnie-Walker-EXP-Steel-Rollator,12125,34.htm.
http://www.etailmedical.net/category/Rollators/4-Wheeled_Rollators?gclid=CJ7njYL43KICFQuB5QodZ0i5zQ.
http://www.phc-online.com/v/vspfiles/html/dolomite_rollator.htm.
http://www.phc-online.com/v/vspfiles/html/guardian_rollator.htm.
http://www.phc-online.com/Invacare_Rollator_Center_s/5430.htm.
http://www.phc-online.com/Rollators_s/1.htm.
http://www.phc-online.com/Winmed_Rollator_Center_s/5561.htm.
http://www.1stseniorcare.com/walkersandrollators.aspx.
http://www.activelivingnow.com/Rolling_Walkers_Rollators_s/30.htm?searching=Y&sort=1&cat=30&show=10&page=3.
http://www.themedicalclub.com/RollingWalkers_s/196.htm?gclid=COHUqJ6w3alCFRBx5QodvmqpyQ.
http://www.themedicalclub.com/FoldingWalkers_s/181.htm.
http://www.alibaba.com/showroom/disabled-walker_2.html.
http://www.medicalproductsdirect.com/merrywalkers.htmi.
http://www.XSMedical.com/Walkers_s/10.htm.
http://www.shop.com/walkers+rollators-Sears-+5?s=97006&q=&k=24&nbc=&nsb=.
http://www.pronto.com/user/search.do?displayQuery=rollator%20walkers&SEM=true&query=rollator%20walkers&adid=1208780533-5669188-0_gs&ref=rollator%20walkers&creativeid=3439023984&site=.
http://www.pronto.com/mpm/shop/rollator-walkers/c-v1_6_67_331/p-12/psz-40/.
http://www.pattersonmedical.com/app.aspx?cmd=get_product&id=88376.
http://www.assistireland.ie/index.asp?locID=1373&docID=1574.
Statement Regarding Inventorship.

* cited by examiner

ROLLATOR HAVING A USER-ADJUSTABLE TRACK WIDTH

FIELD OF INVENTION

The present invention relates to a wheeled walking frame, also known in the art as a rollator, having a track width which can be adjusted while in use, and without the user having to take their weight off of the device.

SUMMARY OF THE INVENTION

In at least one embodiment, a rollator with a variable width track comprising: first and second lower support members; a main pivot connecting said first and second support members, two substantially vertical members, each having a first and a second end, and each connected at or near said first ends to at least one of said lower support members and each connected at or near said second ends to at least one user support member; first and second rear wheel assemblies, one of which is connected to said first lower support member, and the other of which is connected to said second lower support member; first and second front wheel assemblies, each of which are connected to at least one of said lower support members at points forward from said rear wheel assemblies; a first strut having a substantially fixed first length and first and second ends, which is pivotably connected at or near said first end to said first rear wheel assembly and pivotably connected at or near said second end at or near said main pivot; a second strut having a substantially fixed second length and first and second ends, which is pivotably connected at or near said first end to said second rear wheel assembly and pivotably connected at or near said second end at or near said main pivot; wherein said lower support members can be pivoted into a closed position such that said lower support members are at a minimum allowable angle relative to each other, a fully open position in which said lower support members are splayed at the maximum allowable angle relative to each other and said rear wheels are oriented in the direction of travel and the space between said lower support members is free of obstacles, at least one intermediate position in which lower support members are splayed at an angle between said minimum and maximum allowable angles and said rear wheels are oriented in the direction of travel during operation and the space between said lower support members is free of obstacles.

According to one embodiment, a rollator having a variable track width which can be adjusted for use in operation across a range of widths by pivoting a pair of support members, wherein the alignment of the wheels is maintained during operation in the direction of travel across the range of track widths.

In at least one embodiment, the rear wheels are maintained in the direction of travel using strut-type linkages connecting the rear wheels to the support members.

In at least one embodiment, pivoting the lower support members causes the track of the rear wheels to decrease and the track of the front wheels to increase.

In at least one embodiment, the lower support members define a region over which the user can stand, that is free of crossbars and other obstacles.

In at least one embodiment, at least one of the wheels of the rollator is connected to a user-controlled braking mechanism.

In at least one embodiment, the brakes can be maintained in a locked position.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures.

DETAILED DESCRIPTION OF THE EXEMPLARY EMBODIMENTS

The present invention relates to a wheeled walking frame, also known in the art as a rollator, having a variable track width which can be adjusted for use in operation across a range of track widths, and without the user having to take their weight off of the device to adjust the track width.

Figure 1:
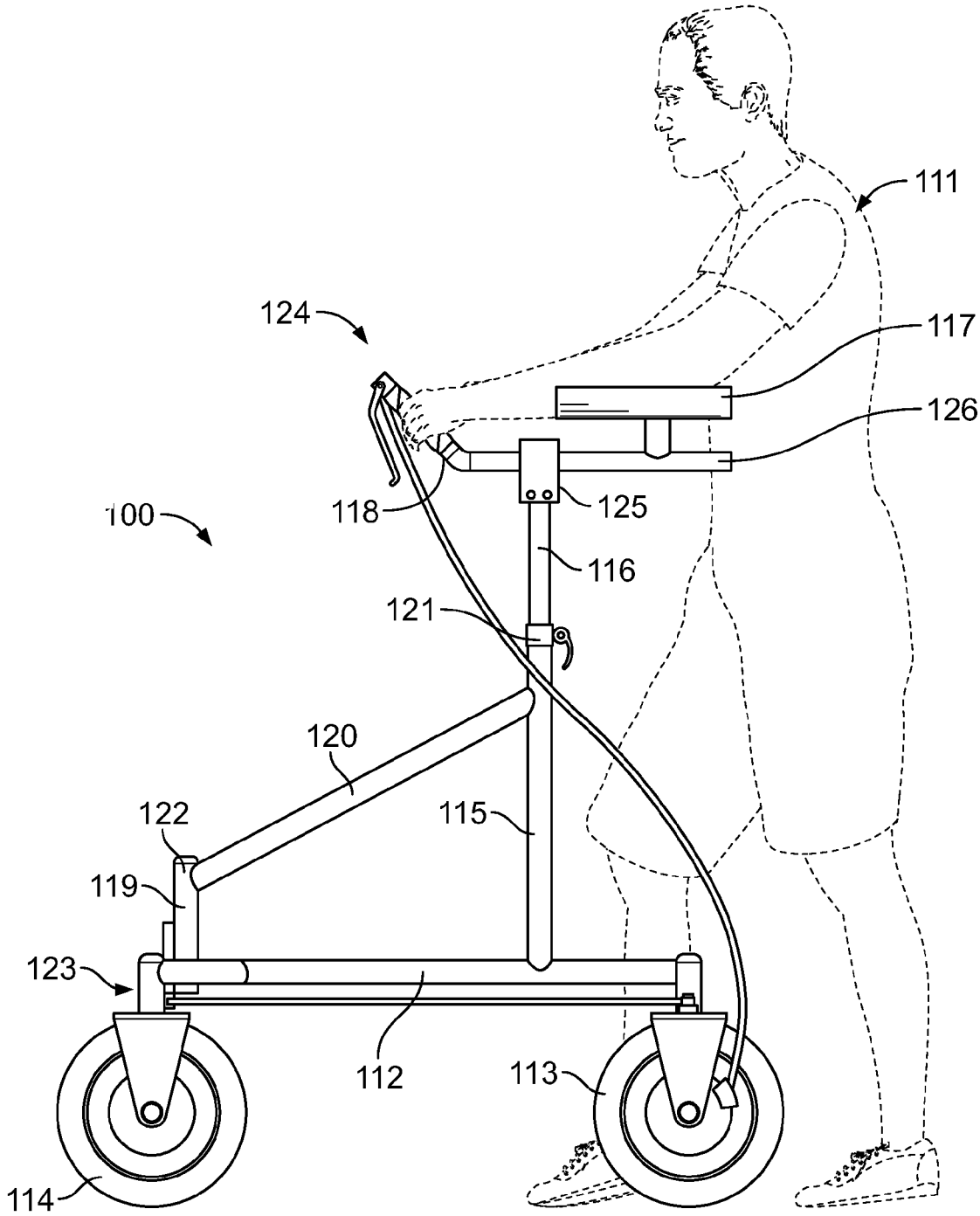
FIG. 1 is a side view of a rollator according to an exemplary embodiment of the present invention in use.

FIG. 1 illustrates an exemplary embodiment of the present invention in use.

As shown in FIG. 1, a rollator 100 of the present invention generally comprises a rolling frame upon which a user 111 can lean on to obtain upper body support while walking. Specifically, the rollator of the present invention may comprise a pair of lower support members 112 pivotably connected to one another by a main pivot 123 at a point forward of the user 111. Vertical support members 115 may be connected to each of lower support members 112 at points between front and rear wheel assemblies 114 and 113. User support members 116 may also be adjustably connected to vertical support members 115 via quick release locking mechanisms 121. For example, the frame elements of the present invention, including support members 112, 115, 119 and 120 may be made of welded steel, aluminum, or titanium tubes or the like. The frame elements may also be made from other materials, such as plastics, carbon fiber and other composites. Other methods of construction, such as adhesive bonding or monocoque construction may be used instead of welding.

In one embodiment, user support member 116 may comprise an elbow support 117 and a handle structure 118. A handle 118 and elbow rest 117 may be adjusted by locking cuffs 125 and 126 to suit the user's preferences. In other embodiments, the user support member 116 may be any one of a number of other user supports, such as a padded chest support, a seat and the like. In some embodiments, a hand brake mechanism 124 for controlling brakes attached to rear wheel assemblies 113 and mounted on a handle 118 may be provided.

In some embodiments, the rollator may also include a third vertical member 119 pivotably connected to first and second lower support members 112 and 120. Main pivot 123 may also include a second bearing 122 disposed at either end of vertical member 119 form a headset. These optional structures may provide the frame with additional torsional rigidity.

Figure 2A:
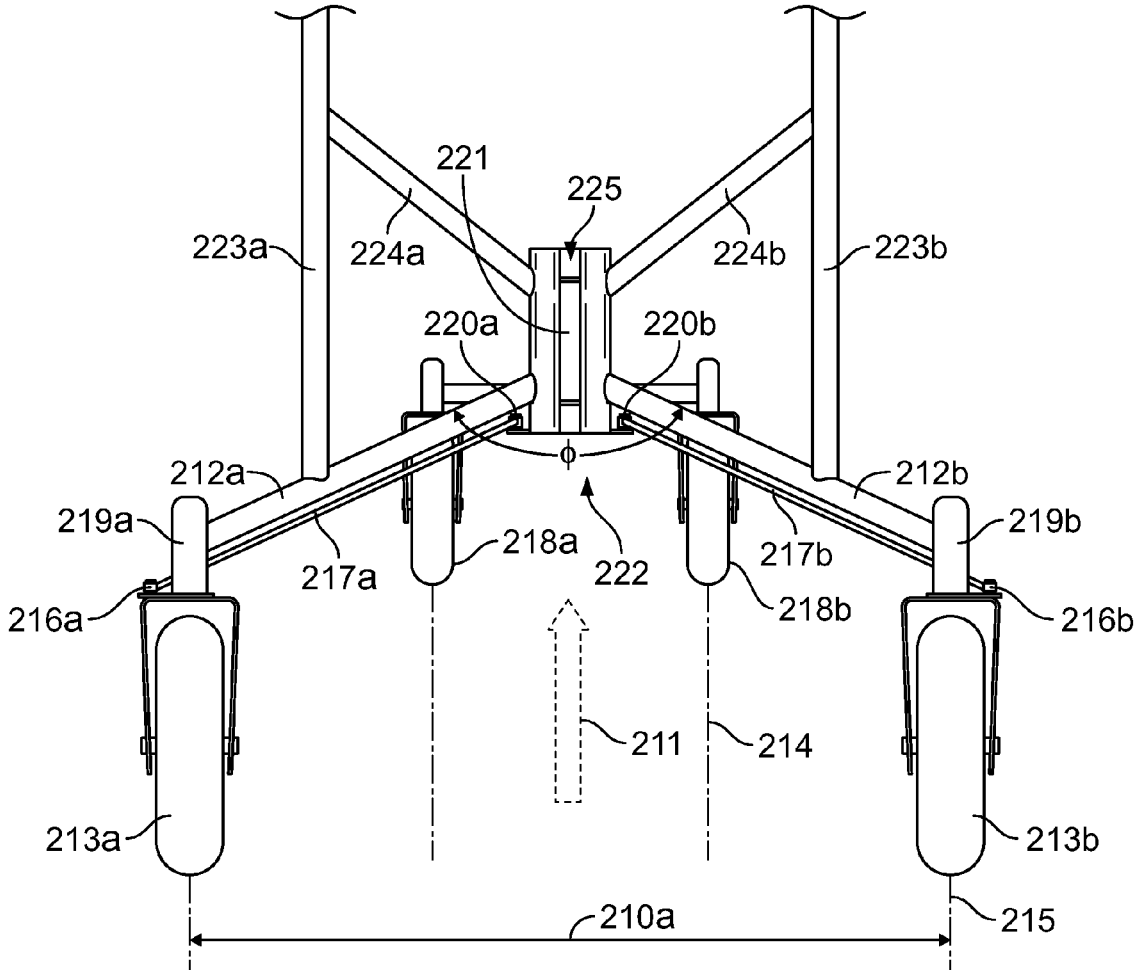
FIG. 2*a* is a rearward view of lower support members according to an exemplary embodiment of the present invention fully splayed.
Figure 2B:
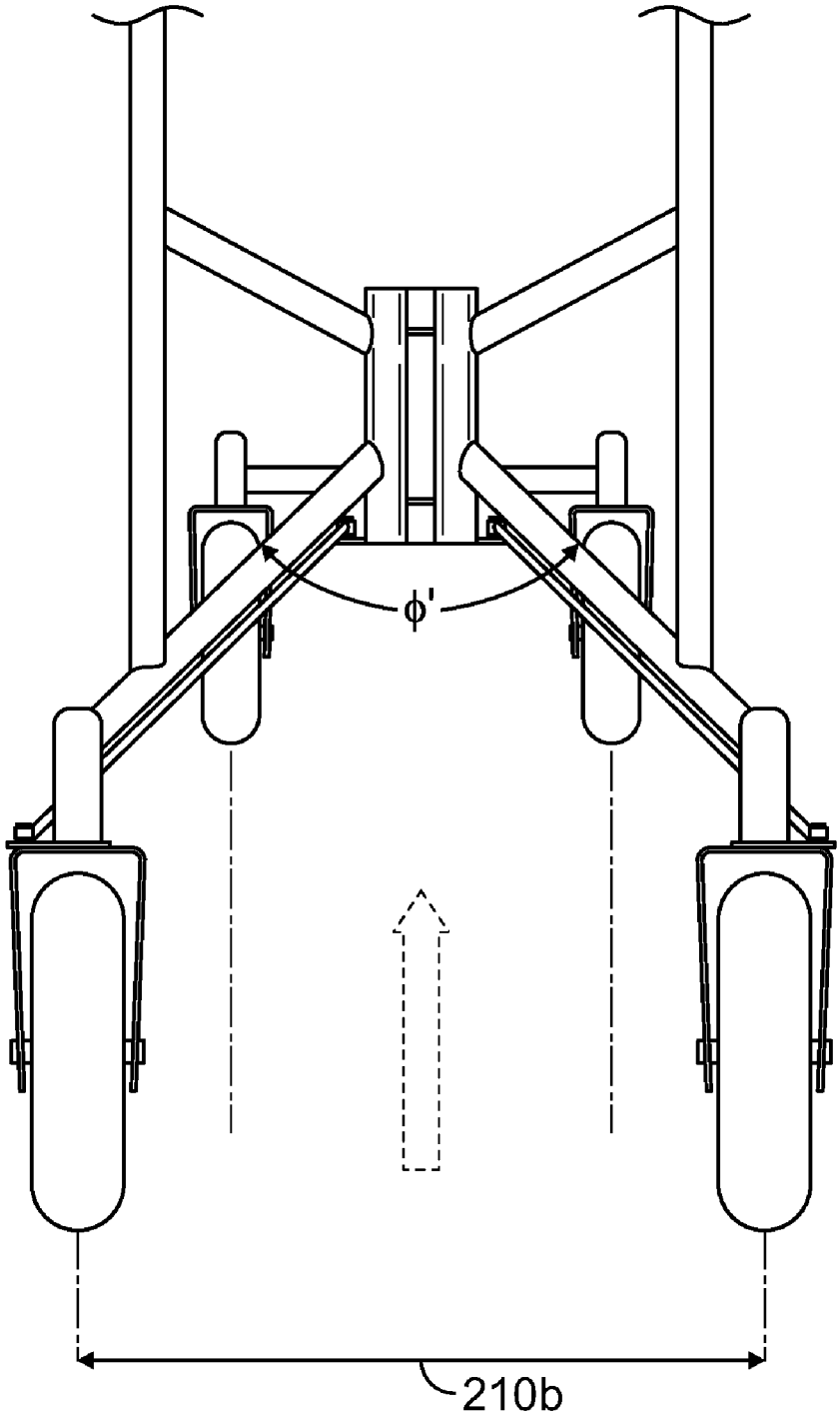
FIG. 2*b* is a rearward view of lower support members according to an exemplary embodiment of the present invention splayed at an intermediate angle.

FIGS. 2*a* and 2*b* illustrate the adjustment of the track width of the rollator according to an exemplary embodiment of the present invention. As shown in FIG. 2*a*, lower support members 212*a* and 212*b* may be pivotably connected by pivot 221. Rear wheel assemblies 213*a* and 213*b* can be pivotably connected to lower support members 212*a* and 212*b* via pivots 219*a* and 219*b*, which may, for example, be brass bushings, sealed cartridge bearings, or any other form of suitable pivot known in the art. Struts 217*a* and 217*b*, may likewise be pivotably connected to wheel assemblies 213*a* and 213*b* and aft points 220*a* and 220*b* by any pivoting structure known in the art. The angle 222 at which lower support members 212*a* and 212*b* are splayed determines the track width 210 between rear wheel assemblies 213*a* and 213*b*. As shown in FIG. 2*a*, both rear wheels 213*a* and 213*b*, and front wheels 218*a* and 218*b* are generally aligned in the direction of travel 211.

As shown in FIG. 2*b*, all four wheels remain generally aligned in the direction of travel 211 even when lower support members 212*a* and 212*b* are pivoted and brought closer to one another at an angle 223 that is less than angle 222. In some embodiments, pivoting the lower support members may cause the rear wheels 213*a* and 213*b* define a wheel track 210*b* that is narrower than wheel track 210*a*. Because the rear wheel assemblies 213*a* and 213*b* remain aligned with the direction of travel 211 across a range of splay angles 222, the present invention allows a user to adjust the track 210 of the device while the device is in use. Additionally, lower support members 212*a* and 212*b* can be brought to a "closed" position at which splay angle 222 is at a minimum. The track width of the rollator may be at its narrowest in this "closed" position, and the rollator may be at its most compact, thereby facilitating stowage and transport of the device. In some embodiments, the device may be further compacted for storage or transport by folding back front wheels 218*a* and 218*b*, and disengaging the locking collars shown in FIG. 8 to remove or lower the user support members.

In the exemplary embodiment shown in FIG. 2*a*, the configuration of lower support members 212*a* and 212*b*, in conjunction with vertical support members 223*a* and 223*b*, 225, and optional second lower support member 224*a* and 224*b* provides a space between lower support members 212*a* and 212*b* and forward of rear wheel assemblies 213*a* and 213*b* which is substantially free of obstacles across a range of splay angles and track widths. Keeping the space between the lower support members free of obstacles helps the user to maintain their feet, and by extension, their center of mass, within the region defined by the four wheels of the rollator. Allowing the user to maintain their center of mass over the wheels of the present invention enables the present invention to provide a very high level of support, adjustability and stability.

Figure 3:
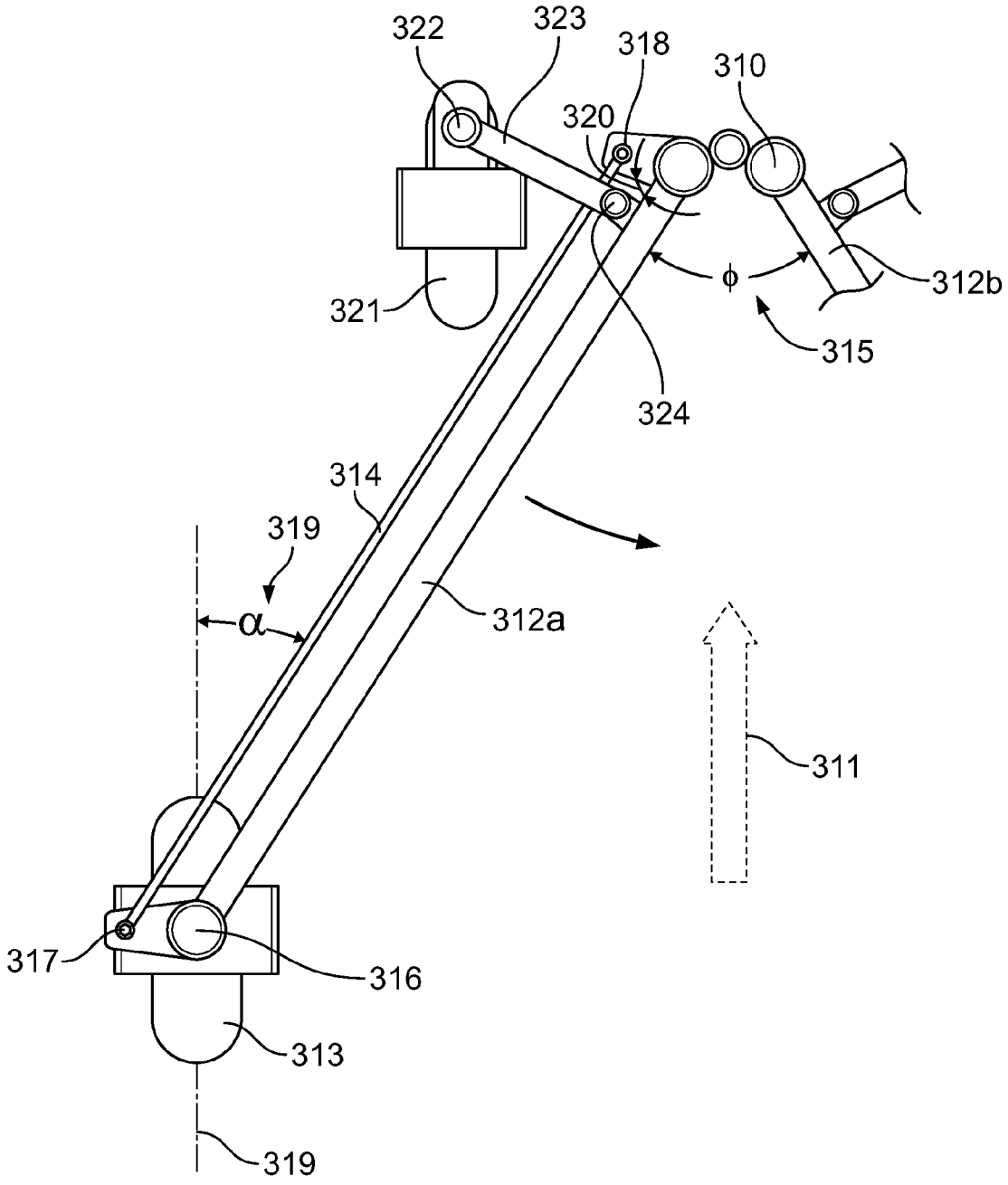
FIG. 3 is an overhead view of lower support members, strut and front and rear wheel assemblies according to an exemplary embodiment of the present invention.

The present invention may maintain the alignment of the rear wheels in the direction of travel across a range of splay angles, as shown in FIG. 3.

FIG. 3 provides an overhead view of lower support members 312*a* and 312*b* according to an embodiment of the present invention. Lower support members 312*a* and 312*b* may be pivotably connected to each other by pivot 310. Lower support member 312*a* may also be connected by a pivot 316 to rear wheel assembly 313. A strut 314 can likewise be connected to wheel assembly 313 at one end by pivot 317 and to either main pivot 310 or a point near it by pivot 318. The direction of travel of wheel assembly 313 is shown by dotted line 319. As shown in FIG. 3, dotted line 319 is generally parallel with the direction of travel of the entire rollator shown by dotted arrow 311.

In one exemplary embodiment of the present invention as shown in FIG. 3, a front wheel assembly 321 may be connected to a support arm 323 via a pivot 322. In some embodiments of the present invention, front wheel assembly 321, may also be permitted to pivot freely, like a caster. Wheel assembly 321 may be configured to be raked such that the wheel contacts the ground at a point behind pivot 322 to diminish the wheel's tendency to wobble during operation. Support arm 323 may be connected to lower support member 312*a* by a pivot 324. In some embodiments, pivot 324 can be a locking or indexed pivot joint, which may allow support arm 323 to be kept firmly in the extended position during use, but easily folded back for storage.

As shown in FIG. 3, strut 314, lower support member 312*a*, and the lines connecting pivots 317 to 316 and 318 to 310 may generally define a parallelogram. If the user, by exerting an inward force on the user support members, brings the lower support members 312*a* and 312*b* closer together, angle 315 will be reduced. The change in angle 315 may be substantially the same as the change in angle 320. Due to the geometry of the lower support member and struts, a change in angles 315 and 320 will produce a similar change in angle 319, meaning that the angle between strut 314 and the direction of rear wheel travel 319 will be reduced to offset the effect of the change in angle 315. In this way, the rear wheels of the present invention may be maintained at all times in the direction of travel of the rollator, regardless of splay angle 315.

Figure 3A:
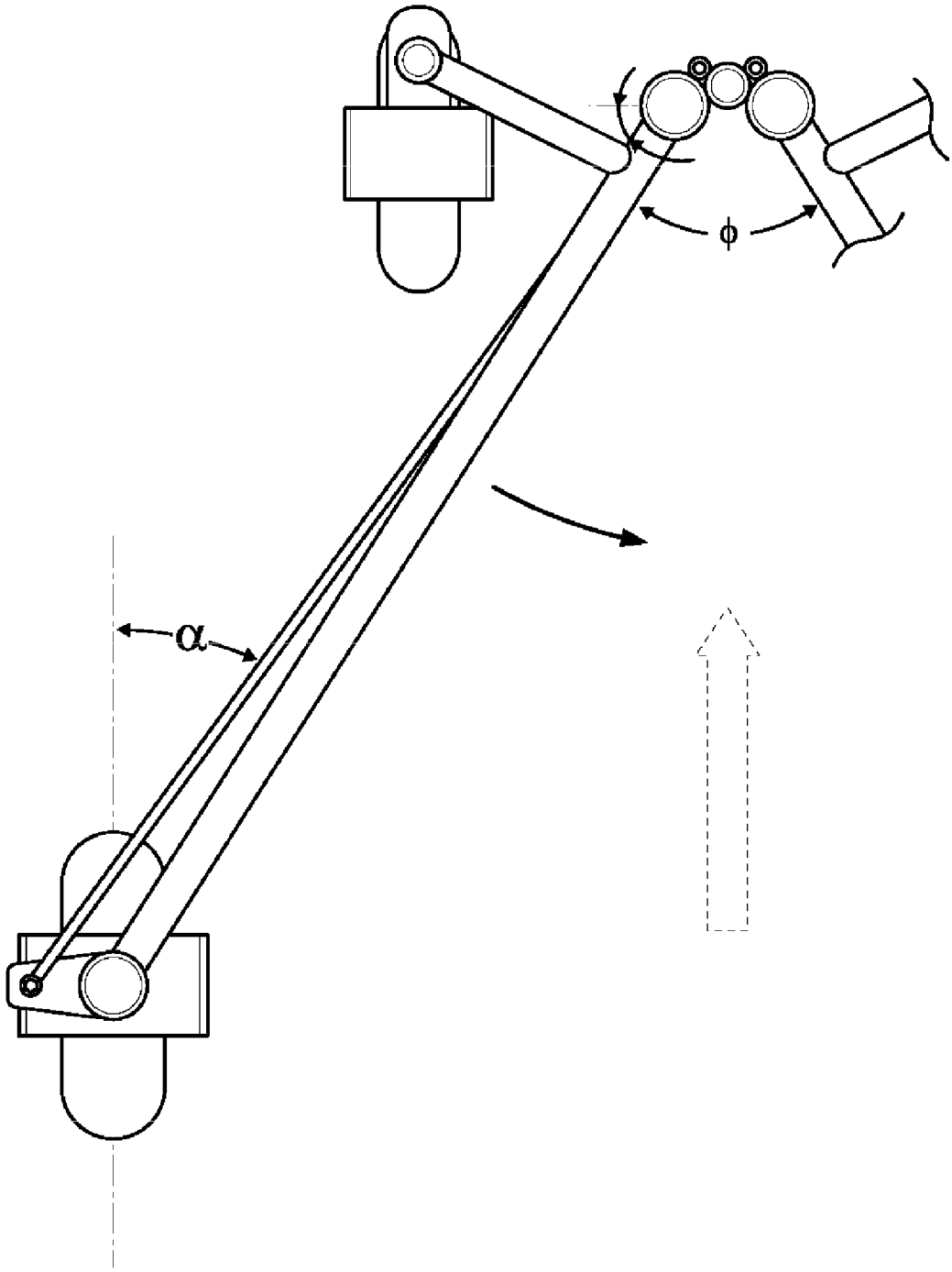
FIG. 3A is overhead view of lower support members, strut and front and rear wheel assemblies according to another exemplary embodiment of the present invention.

Persons of skill in the art will appreciate the range of possible variations on the embodiment shown in FIG. 3, which is not intended to limit the invention as a whole. For example, the configuration of struts and support members may be simplified, as shown in FIG. 3A, by moving pivot 318 to a point at or near the axis of rotation of pivot 310, thereby eliminating the need for a flange or other structure to separate pivots 310 and 318.

Figure 4:
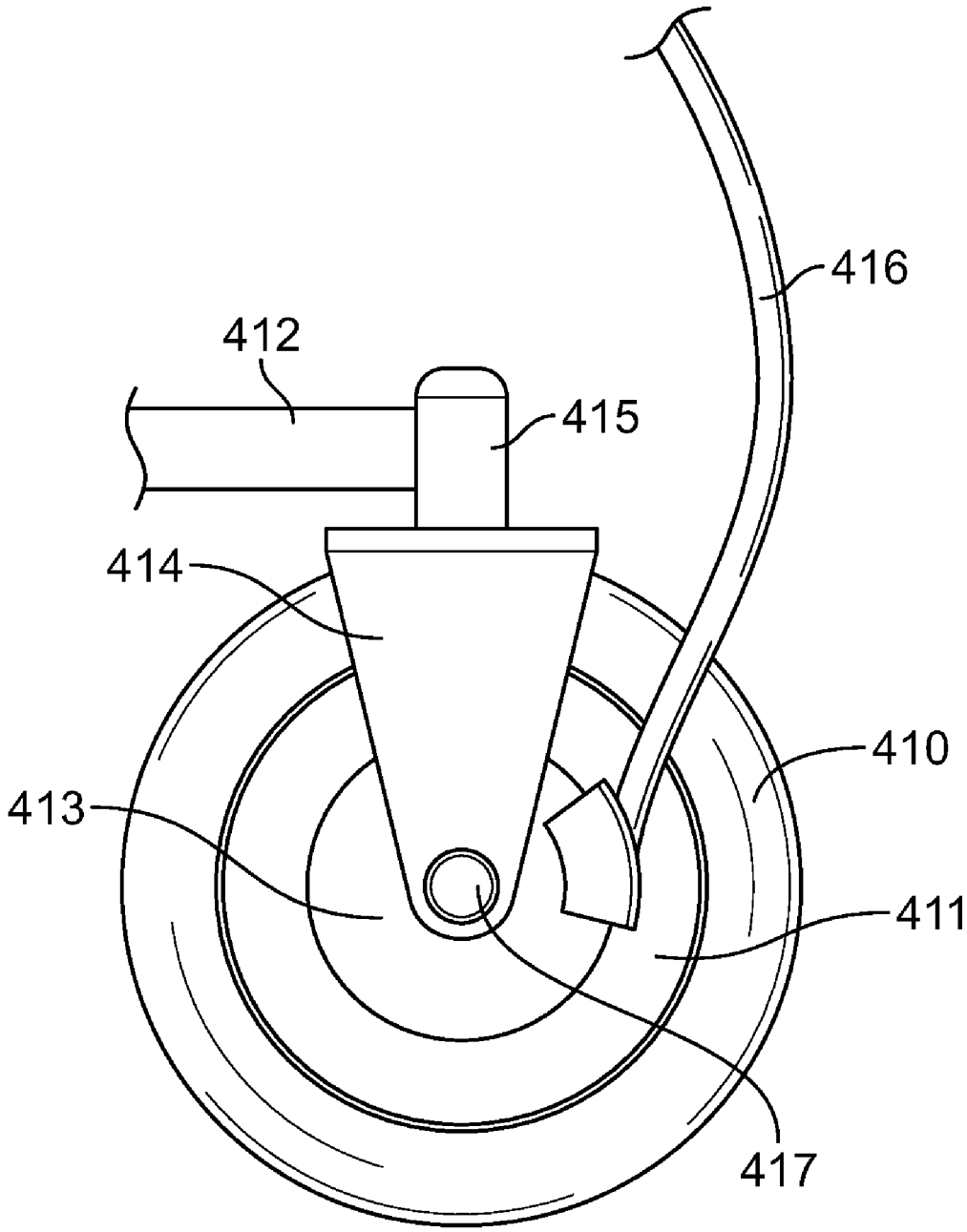
FIG. 4 is a side view of a rear wheel and brake assembly according to an exemplary embodiment of the present invention.

FIG. 4 provides a detailed side view of a rear wheel assembly according to an embodiment of the present invention. The wheel assembly may comprise a rim 411, to which a tire 410 can be mounted. In some embodiments, the wheel has a relatively large diameter, to facilitate travel over uneven and obstacle-strewn surfaces on which small diameter wheels, or wheels made of plastic or hard rubber might get stuck. The wheel may be connected to a fork structure 414 via a rigid axle 417. A brake 413 may also be mounted to fork assembly 414. For example, the brake assemblies may include the band-and-drum style brakes used on minibikes and go-karts, or small, drum, disc or caliper brakes of the sort used on bicycles. Brake 413 may be actuated by a cable within cable housing 416. Cable housing 416 may be a flexible cable housing and may be routed through the tube of the rollator for a cleaner appearance. Fork 414 and the wheel can be attached to lower support member 412 via pivot 415, which may be a cartridge bearing, bushing, or other suitable pivot known in the art.

Figure 5:
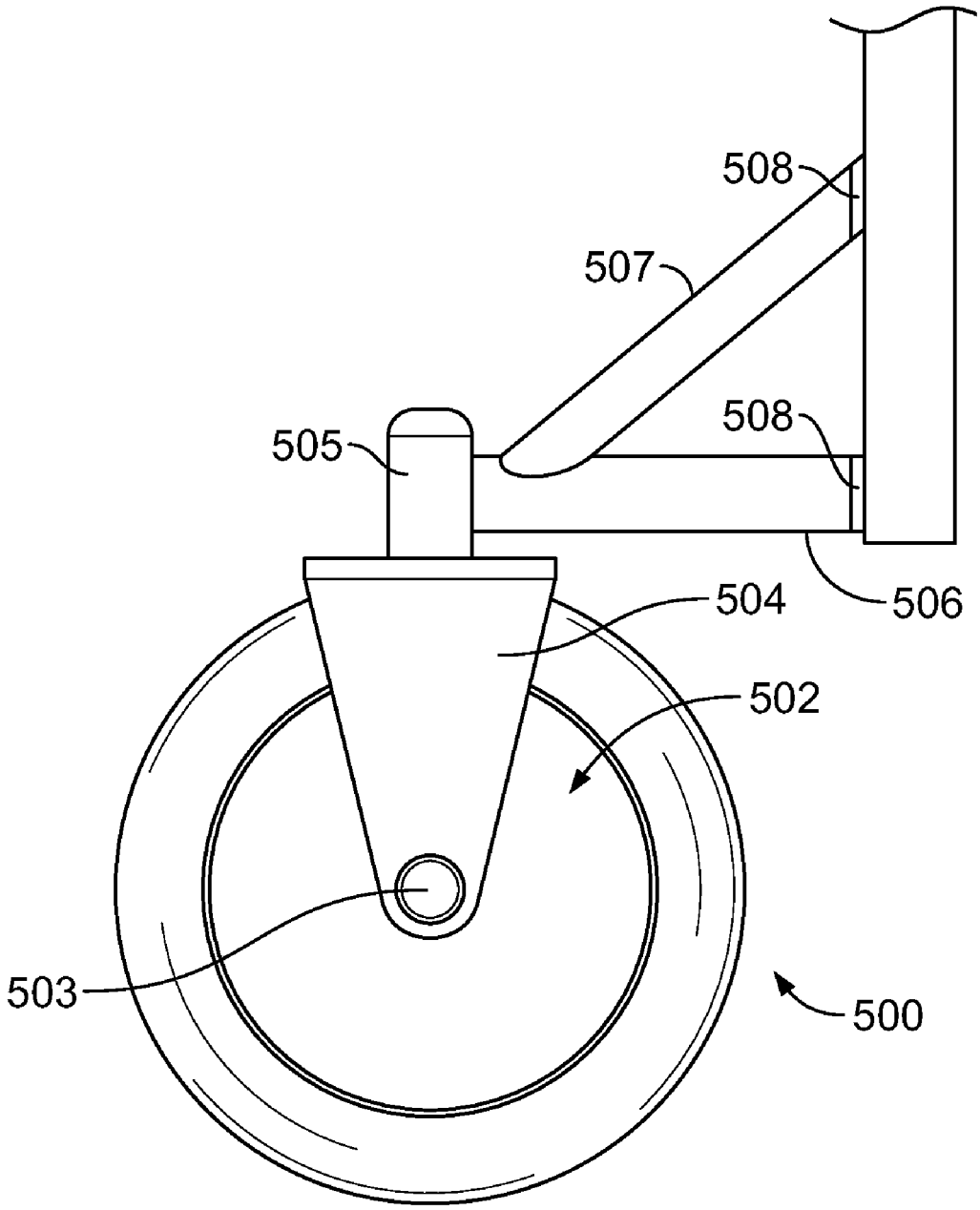
FIG. 5 is a side view of a front wheel assembly according to an exemplary embodiment of the present invention.
Figure 5A:
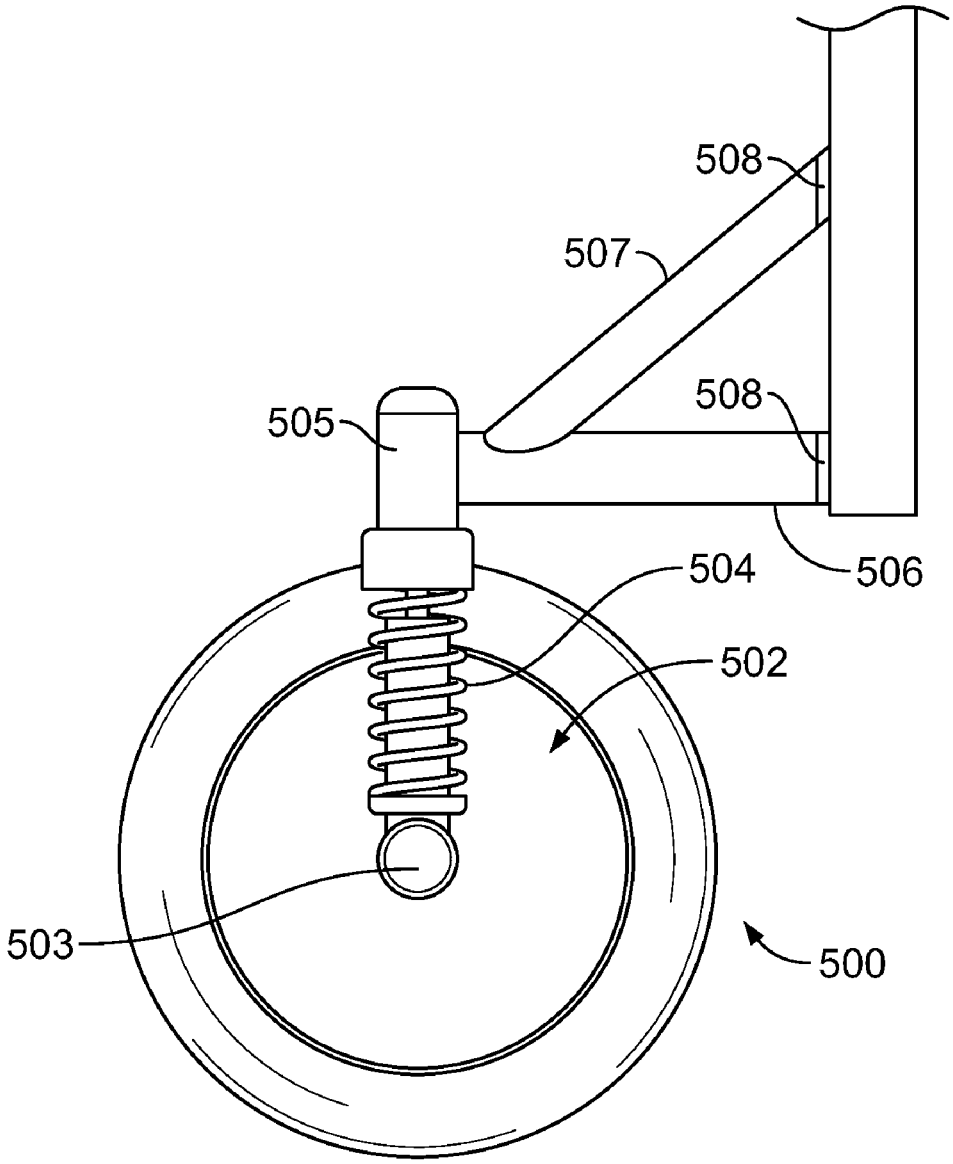
FIG. 5A is a side view of a front wheel assembly according to another exemplary embodiment of the present invention

FIGS. 5 & 5A provide detailed side views of front wheel assemblies according to exemplary embodiments of the present invention. As shown in FIG. 5, the wheel assembly may comprise a rim 502 on which a tire 501 may be mounted. As with the rear wheel assemblies shown in FIG. 4, front wheel 500 may have a relatively large diameter to facilitate travel across rough or uneven surfaces. Wheel 500 may be rotatably attached to a fork 504 via axle 503. Depending on the application, fork 504 may be rigid, as shown in FIG. 5, or telescoping or otherwise be configured to suspend wheel 500 to allow the wheel to move up and down to traverse obstacles, as shown in FIG. 5A. For example, the suspension of fork 504 may be an elastomeric bumper, trailing arm or other suitable suspension known in the art. Fork 504 may be connected to a support arm 506 via a pivot 505. Pivot 505 may be a brass bushing, cartridge bearing, or other suitable pivot known in the art. The front wheel assembly may be raked such that axle 503 is offset from the axis of rotation of pivot 505 either by angling fork 504 or offsetting the attachment point for axle 503, so that there is some offset between pivot 505 and the point of contact between wheel 500 and the ground. Fork rake may help to maintain the alignment of freely pivoting wheel 500 in the direction of travel of the rollator by discouraging the tendency of the front wheel to wobble. In some embodiments support arm 506 may be buttressed with a second support arm 507, which may increase the rigidity and ruggedness of the wheel assembly. The wheel assembly may be mounted to either the main pivot or to the lower support members by a locking pivot or bushing that maintains the wheel assembly in an extended position during use and allows it to be folded back for storage.

Figure 6:
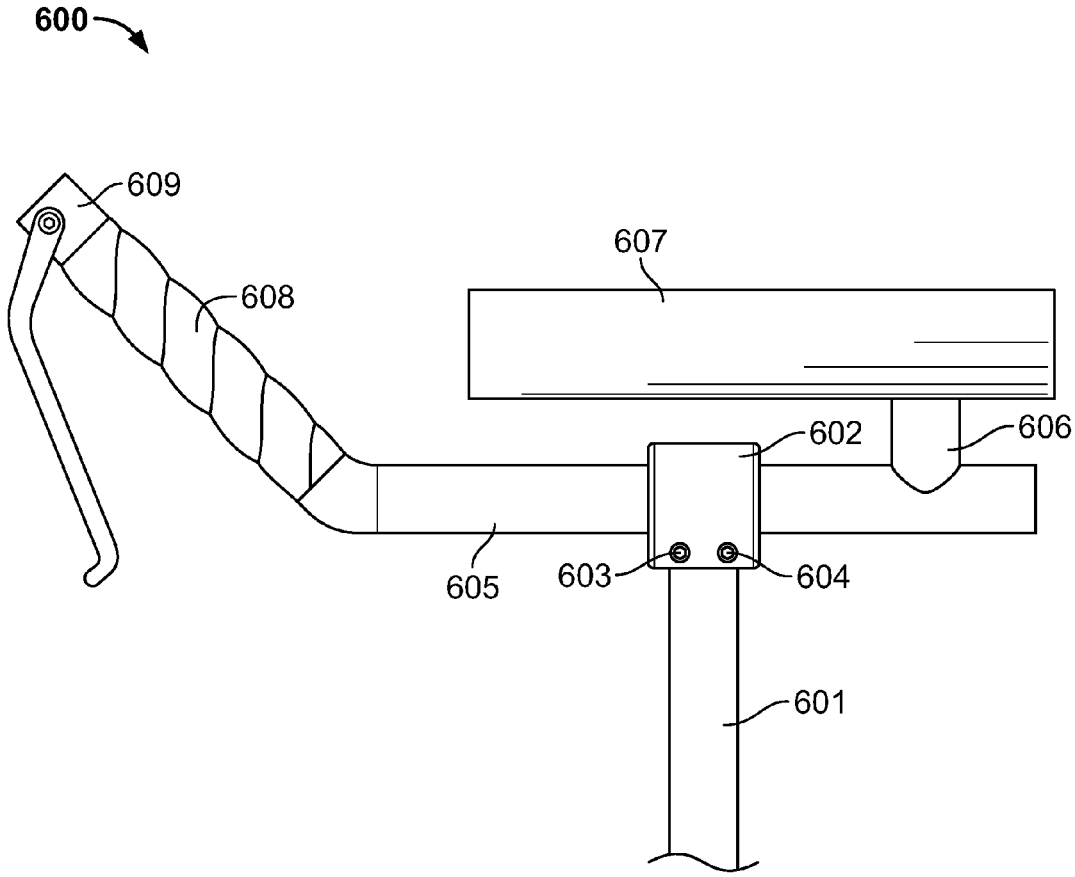
FIG. 6 is a side view of a user support member according to an exemplary embodiment of the present invention.
Figure 8:
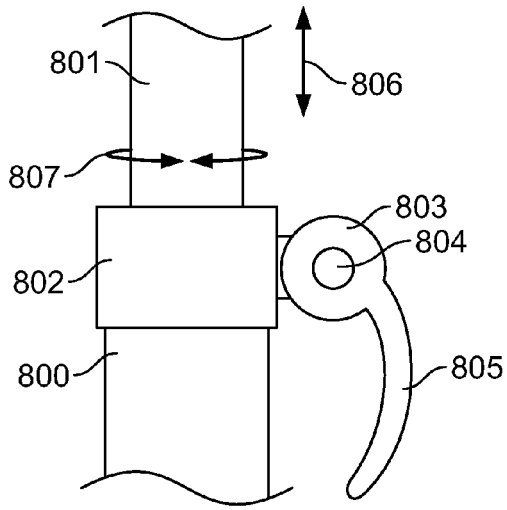
FIG. 8 is a side view of a user-adjustable locking mechanism linking the vertical members and the user support members according to an exemplary embodiment of the present invention.

FIG. 6 provides a detailed side view of a user support member 600 according to an exemplary embodiment of the present invention. In this exemplary embodiment, user support member 600 may comprise a substantially tubular member 601 that can be adjustably mated via to a locking member, such as shown in FIG. 8, to allow for height and angular adjustment. A locking cuff or clamp 602 for holding handle/horizontal support member 605 may be provided at or near one end of vertical member 601. Adjustment members, such as set screws 603 and 604 on clamp 602 can be loosened to allow handle 605 to be adjusted longitudinally and rotationally according to the user's preferences and then tightened to lock the handle in place. A substantially vertical member 606 may join handle/horizontal support member 605 to arm rest 607. For example, arm rest 607 may comprise a semicircular section of plastic, metal, or some other substantially rigid material upon which a layer of foam rubber, neoprene or other suitable padding material can be attached to form a padded armrest.

Handle/horizontal support member 605 may bend upward at a point forward of the locking cuff 602 to provide a substantially non-horizontal section for use as a grip or handle by the user. In some embodiments, it may be preferable to wrap this substantially non-horizontal section with handle bar wrap 608, cork tape, neoprene or any other suitable shock absorbent material to form a comfortable handle. A brake lever 609 may, in some embodiments, be provided on handle/horizontal support member 605 for controlling a set of brakes.

Figure 7:
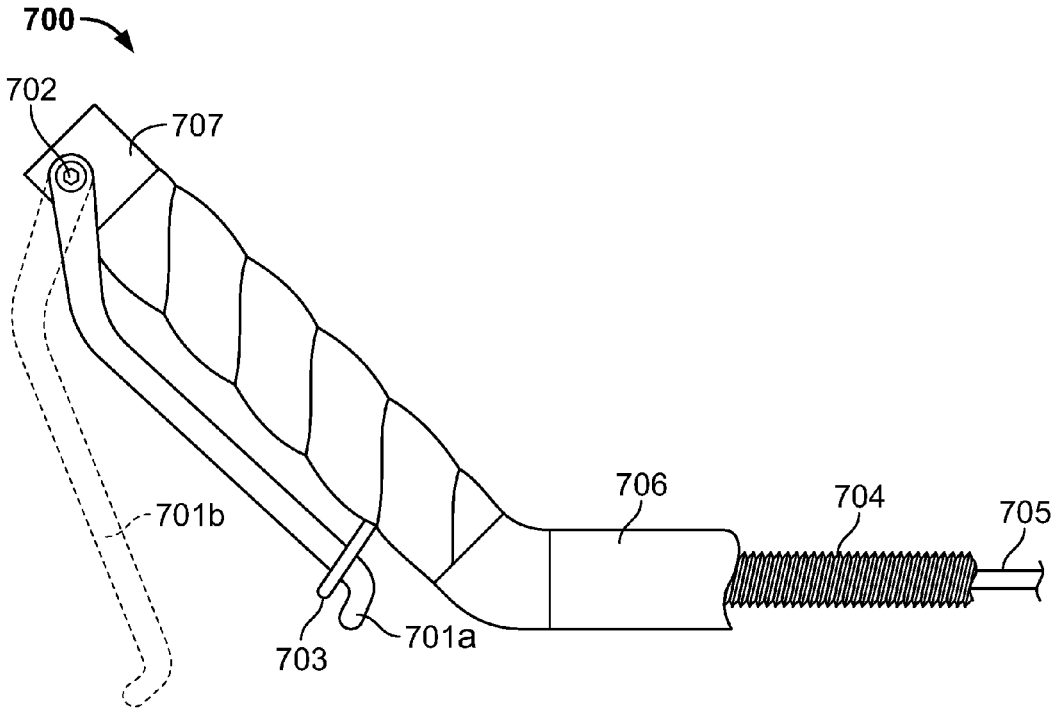
FIG. 7 is a side view of a brake locking mechanism according to an exemplary embodiment of the present invention.

FIG. 7 shows a detailed side and cutaway view of a brake lock mechanism 700 according to an exemplary embodiment of the present invention. As shown in FIG. 7, a hand brake actuator 707 may be mounted on one end of handle/horizontal support member 706. Hand brake actuator 707 can be a handle 701 attached to a pivot 702 for producing a tension on brake cable 705 which may be disposed within a substantially rigid cable housing 704. Cable 705 and housing 704 may be routed within handle 706 for a clean appearance and to avoid snagging the cable.

Brake lever 701 can be maintained in a fully depressed position, thereby keeping the brakes engaged, by a pivoting ring 703. To lock the brakes, the user may depress brake lever 701 and bring pivoting ring 703 over the brake lever to lock it in a depressed position. Pivoting ring 703 may be positioned such that when the user squeezes brake lever 701*a*, pivoting ring 703 will swing downwards, releasing brake lever 701, and allowing it to spring back to a rest position shown by 701*b*. Persons of skill in the art will realize that a ratcheting mechanism, lock pin or other structure may be substituted for pivoting ring 703 to achieve the same result. Locking of the brakes prevents the wheels of the rollator from rolling when the user's hands are unable to operate the brake lever. For users with limited mobility, this feature is very helpful when the user is standing still, getting up, or otherwise needs the support of the rollator, but does not yet have their hands on a handle 706.

FIG. 8 provides a detailed side view of a locking mechanism used to adjustably mate user a support member 801 to a vertical support member 800 in an exemplary embodiment of the present invention. As shown in FIG. 8, both vertical support member 800 and user support member 801 may be made from substantially tubular sections proportioned such that user support member 801 may be inserted into vertical member 800 in a way that allows for telescopic motion 806 and rotational motion 807, but still fitting snugly enough to provide lateral stability. User support 801 can be locked into place by a locking collar 802. To facilitate easy adjustment of the height and angle of user support 801, the tension in locking collar 802 may be controlled by a hand operated quick release 804. For example, hand operated quick release 804 may be of the type commonly used to secure the seat post within the seat tube of a bicycle. In another embodiment, quick release 804 may comprise a pivoting cam 803 connected to a hand operated lever 805, that can apply a variable tension to lock collar 802.

Now that embodiments of the present invention have been shown and described in detail, various modifications and improvements thereon will become readily apparent to those skilled in the art. Accordingly, the exemplary embodiments of the invention, as set forth above, are intended to be illustrative, not limiting. The spirit and scope of the present invention is to be construed broadly and limited only by the appended claims, and not by the foregoing specification.

What is claimed is:

1. A rollator with a variable width track comprising:

a) first and second lower support members;

b) a main pivot connecting said first and second support members;

c) two substantially vertical members, each having a first and a second end, and each connected at or near said first ends to at least one of said lower support members and each connected at or near said second ends to at least one user support member;

d) first and second rear wheel assemblies, one of which is connected to said first lower support member, and the other of which is connected to said second lower support member;

e) first and second front wheel assemblies, each of which are connected to at least one of said lower support members at points forward from said rear wheel assemblies;

f) a first strut having a substantially fixed first length and first and second ends, which is pivotably connected at or near said first end to said first rear wheel assembly and pivotably connected at or near said second end at or near said main pivot;

g) a second strut having a substantially fixed second length and first and second ends, which is pivotably connected at or near said first end to said second rear wheel assembly and pivotably connected at or near said second end at or near said main pivot;

wherein said lower support members can be pivoted into:

a closed position such that said lower support members are at a minimum allowable angle relative to each other;

a fully open position in which said lower support members are splayed at the maximum allowable angle relative to each other and said rear wheels are oriented in the direction of travel and the space between said lower support members is free of obstacles;

at least one intermediate position in which lower support members are splayed at an angle between said minimum and maximum allowable angles and said rear wheels are oriented in the direction of travel during operation and the space between said lower support members is free of obstacles.

2. The rollator of claim 1 further comprising:

a) a braking mechanism configured to engage one or more of the wheels when a brake force is applied;

b) at least one hand brake actuator, wherein said hand brake actuator is used to effectuate the brake force.

3. The rollator of claim 2, wherein said hand brake actuator can be locked into a closed position in which the brake force remains applied to the wheels.

4. The rollator of claim 1, wherein the front wheel assemblies are mounted on pivoting arms to at least one of each of the lower support members.

5. The rollator of claim 1, wherein the front wheel assemblies are mounted to each of said lower support members such that the track of the front wheel assemblies does not decrease when said lower support members are brought closer to reduce the rear track width.

6. The rollator of claim 1, wherein the lower members can be locked in at least one intermediate position wherein said lower support members are splayed at an angle between said minimum and maximum angles.

7. The rollator of claim 1, wherein the lower members can be locked in at least one intermediate position wherein the wheels are locked at a track width between the maximum and minimum allowable track widths.

* * * * *